US006626519B1

(12) United States Patent
McAlonis

(10) Patent No.: US 6,626,519 B1
(45) Date of Patent: Sep. 30, 2003

(54) CONNECTOR ASSEMBLY FOR PRINTER INK CARTRIDGE

(75) Inventor: Matthew R. McAlonis, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 15 days.

(21) Appl. No.: 10/091,928

(22) Filed: Mar. 5, 2002

(51) Int. Cl.[7] ..... B41J 2/14; B41J 2/16

(52) U.S. Cl. ..... 347/50

(58) Field of Search ..... 347/50, 40, 20, 347/44, 47, 27, 63, 84, 85, 86, 87; 439/76.1, 188

(56) References Cited

U.S. PATENT DOCUMENTS 5,025,526 A * 6/1991 Ichitsubo et al.

* cited by examiner

*Primary Examiner*—Raquel Yvette Gordon

(57) ABSTRACT

An electronic cartridge assembly is provided for conducting power and data signals from a printer circuit board to a pen substrate. The assembly utilizes a pen connector that includes a housing and contacts secured to the housing and adapted for carrying electrical power and data signals. Each contact includes a connector pad located at one end of the contact and a tail end located at an opposite end of the contact. The connector pads are adapted to electrically engage mating contacts, and the tail ends are adapted to be bounded to the pen substrate. The housing holds the tail ends in a first plane arranged in rows separated by a first distance, and the housing holds the connector pads in a second plane arranged in rows separated by a second distance. The first distance and second distance differ from one another.

20 Claims, 13 Drawing Sheets

CONNECTOR ASSEMBLY FOR PRINTER INK CARTRIDGE

BACKGROUND OF THE INVENTION

Certain embodiments of the present invention generally relate to an electric connector for transporting power and electric signals. More particularly, certain embodiments of the present invention relate to a surface mount connector that provides a separable interface between a printer connector and a substrate.

A typical inkjet printer includes a printer cartridge that is controlled to dispense certain colors and amounts of ink onto paper in particular patterns. The colors and patterns are controlled by power and data signals supplied by the printer to the printer cartridge. A printer cartridge connector system connects the printer cartridge to a circuit board within the inkjet printer in a manner that allows the printer cartridge to be easily replaced. The printer cartridge connector system comprises a pen connector, a printer connector, and a pen substrate. Inkjet printers provide power and data signals through the circuit board to the printer connectors, which in turn convey the power and data signals through the pen connectors to the pen substrates to dispense certain colors and amounts of ink onto paper.

A conventional printer cartridge connector system exists that utilizes a printer connector that transfers power and data signals from a circuit board to a pen housing. The pen housing includes a pen assembly and a pen substrate. The pen substrate is aligned perpendicularly to the pen assembly. The pen assembly includes a flexible film cover that extends along a front surface down to the pen substrate which is located on a bottom surface perpendicular to the front surface. The flexible film contains contact pads that receive power and data signals from the printer connector and are connected to the pen substrate by wire traces located within the flexible film. The wire traces are wire bonded or soldered to the pen substrate and carry the data and power signals from the contact pads to the pen substrate.

The conventional printer connector includes a housing, compressive springs, and plunger contacts. The housing is mounted on the circuit board and includes a front surface containing apertures. The springs are located within the housing in alignment with the apertures and contact the printed circuit board. The plunger contacts extend out of the housing through the apertures and are retractable into the housing.

In operation, the circuit board conducts power and data signals from the printer to the springs. The pen housing and printer connector are aligned with each other within the printer cartridge connector system so that the plunger contacts touch the contact pads and are pushed into the housing of the printer connector in electrical contact with the springs. The plunger contacts then conduct the power and data signals to the contact pads which, in turn, conduct the power and data signals down to the pen substrate via the wire traces.

The printer cartridge connector system suffers from several flaws. First, the printer cartridge connector system as a whole involves too many discrete components that are both delicate and intricate, which creates a large risk of failure or damage. Second, the printer connector housing is bulky and takes up more space within the printer cartridge connector system than desired. Third, a separate wire trace is needed to connect each contact pad to the pen substrate, thereby creating a large collection of wire traces within the flexible film. Also, wire bonding each wire trace to the pen substrate is a time consuming and delicate process. Finally, the flexible film cover used to retain the contact pads on the front surface of the pen housing is expensive.

Thus a need exists for a printer cartridge connector system that connects a printer connector surface to a perpendicular pen substrate without taking up a significant amount of space or requiring several intricately connected components.

BRIEF SUMMARY OF THE INVENTION

Certain embodiments include an electronic cartridge connector assembly for conducting power and data signals from a printed circuit board to a substrate. The connector assembly includes a housing adapted to be secured to an electronic cartridge. The connector assembly also includes contacts secured to the housing and adapted for carrying power and data signals to the electronic cartridge. Each contact has a tail end adapted to be bounded to the substrate and a connector pad at an end opposite to the tail ends. The connector pads are adapted to electrically engage mating contacts. The tail ends are held within the housing in a first plane and arranged in rows spaced apart by a first distance. The connector pads are held within the housing in a second plane arranged in rows spaced apart by a second distance. The first distance and the second distance differ from each other.

The first plane and second plane may intersect each other, and the tail ends of the contacts may be directly connectable to a substrate surface by reflow soldering. The tail ends may be arranged in at least first and second rows having respective first and second center lines spaced apart by the first distance, and the connector pads may be arranged in at least first and second rows having respective first and second centerlines spaced apart by the second distance.

Each contact may include a stem portion extending from the tail end to the connector pad. The stem portion includes a flared retention barb that is wider than the stem portion. The flared retention barb frictionally engages the housing in order to retain a corresponding connector pad within the second plane by resisting normal forces experienced by the corresponding connector pad from a mating contact. Each contact may include a retention beam that extends from the connector pad. The retention beam is snapably received into a recess in the housing in order to resist normal forces experienced by the connector pad from a mating contact. Each stem portion includes an alignment arm that extends transverse to a longitudinal axis of the stem portion. The alignment arm is located along the stem portion and relative to the tail ends so that when the alignment arm is received in a transverse slot in the housing, the alignment arm locates the tail end in the first plane.

In certain embodiments, at least one contact may include an alignment member spaced a predefined distance from the tail end. The housing may include channels that receive the contacts, and at least one of the channels may have notches therein to receive the alignment member. The notches and the alignment member cooperate to locate the tail end in the first plane. Each stem portion further includes an enlarged segment configured to be releasably joined to a carrier strip before the contacts are secured to the housing. The enlarged segments are aligned in a common plane proximate a rear face of the housing, and the contact pads are aligned in the second plane proximate a front face of the housing.

In certain embodiments, the housing further includes a plurality of channels aligned parallel to one another and opening through a rear face of the housing. Each of the channels has an open bottom end that exposes the tail ends of the contacts, and each of the channels communicates with a hole that extends through a front face of the housing. The holes expose the connector pads through the front face. The channels are of alternate length. The channels separate the holes from the bottom ends by alternative distances. The channels may include support members that traverse the channels and support the contacts.

Optionally, in certain embodiments, the electronic cartridge connector assembly further includes a printer connector that has a plurality of slots that retain an equal plurality of spring contacts therein. The spring contacts have first ends secured in corresponding first ends of the slots and second ends that are biased outward from the second ends of the slots. The second ends of the spring contacts directly electrically engage the connector pads. The spring contacts are deflectable inward toward the slots, and the first ends of the spring contacts are configured to be directly soldered to a printed circuit board.

The foregoing summary, as well as the following detailed description of certain embodiments of the present invention, will be better understood when read in conjunction with the appended drawings. It should be understood, however, that the present invention is not limited to the arrangements and instrumentality shown in the attached drawings.

DETAILED DESCRIPTION OF THE INVENTION

Figure 1:
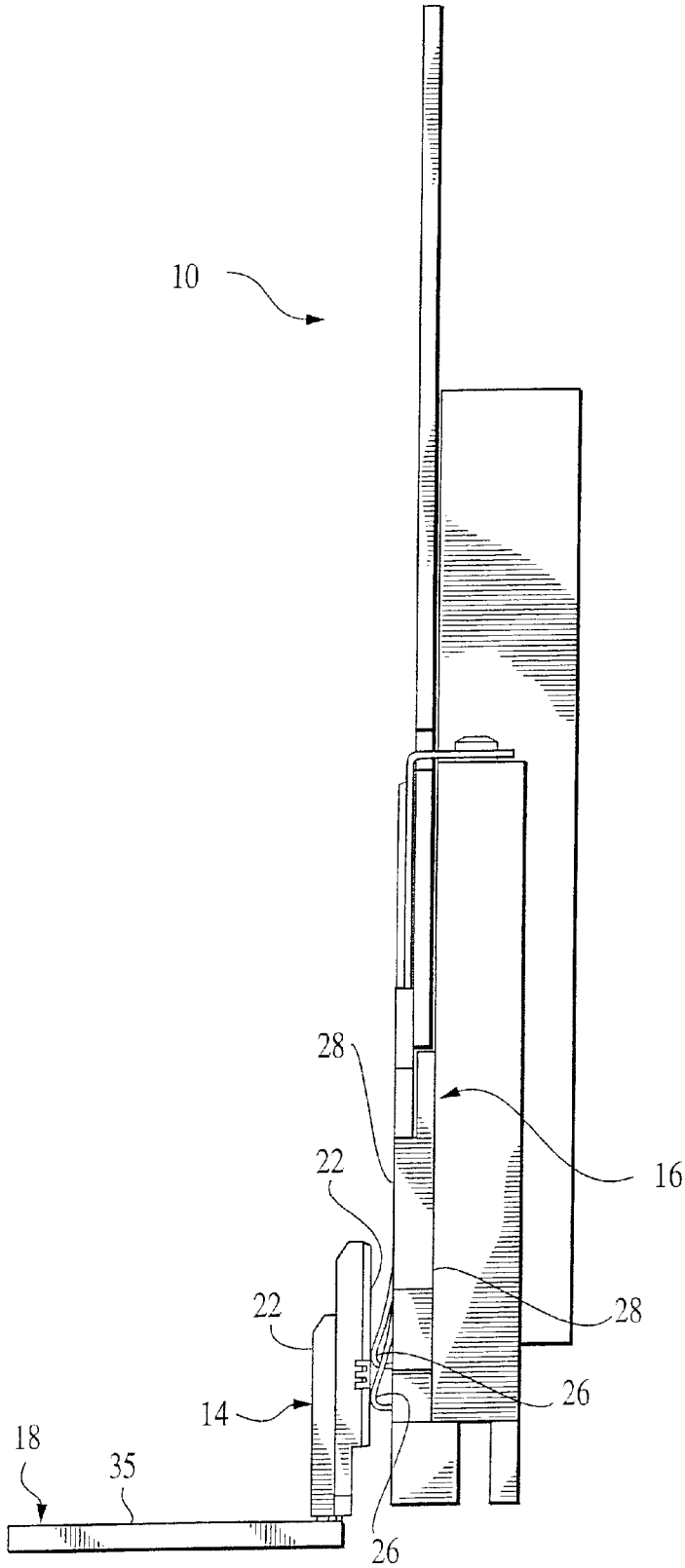
FIG. 1 illustrates a cutaway side view of an electronic cartridge connector assembly in accordance with an embodiment of the present invention.

FIG. 1 illustrates a cutaway side view of an electronic cartridge connector assembly 10 formed in accordance with an embodiment of the present invention. The connector assembly 10 includes a pen connector 14, a printer connector 16, and a pen substrate 18. An assembly housing (not shown) contains and orients the pen connector 14, the printer connector 16, and the pen substrate 18. The pen connector 14 is a generally planar substrate that is oriented upright so that side edges 22 are perpendicular to the pen substrate 18. The pen connector 14 conducts power and data signals from the printer connector 16 to the pen substrate 18.

The printer connector 16 may be a generally planar substrate that includes deflectable, spring contacts 26. The printer connector 16 is positioned so that side edges 28 are generally parallel to the side edges 22 of the pen connector 14. The printer connector 16 includes spring contacts 26 that extend outward at an angle A acute to the side edges 28 toward the pen connector 14. The spring contacts 26 electrically engage the pen connector 14. The printer connector 16 provides power and data signals to the pen substrate 18 via the pen connector 14.

The pen substrate 18 may be a generally planar substrate that has a top surface 35 soldered to the pen connector 14 so that the pen substrate 18 is suspended with the top surface 35 situated generally perpendicular to the side edges 22 of the pen connector 14. The pen substrate 18 receives power and data signals from the printer connector 16 via the pen connector 14. The pen substrate 18 uses the power and data signals to dispense the appropriate amount, pattern, and color of ink.

Figure 2:
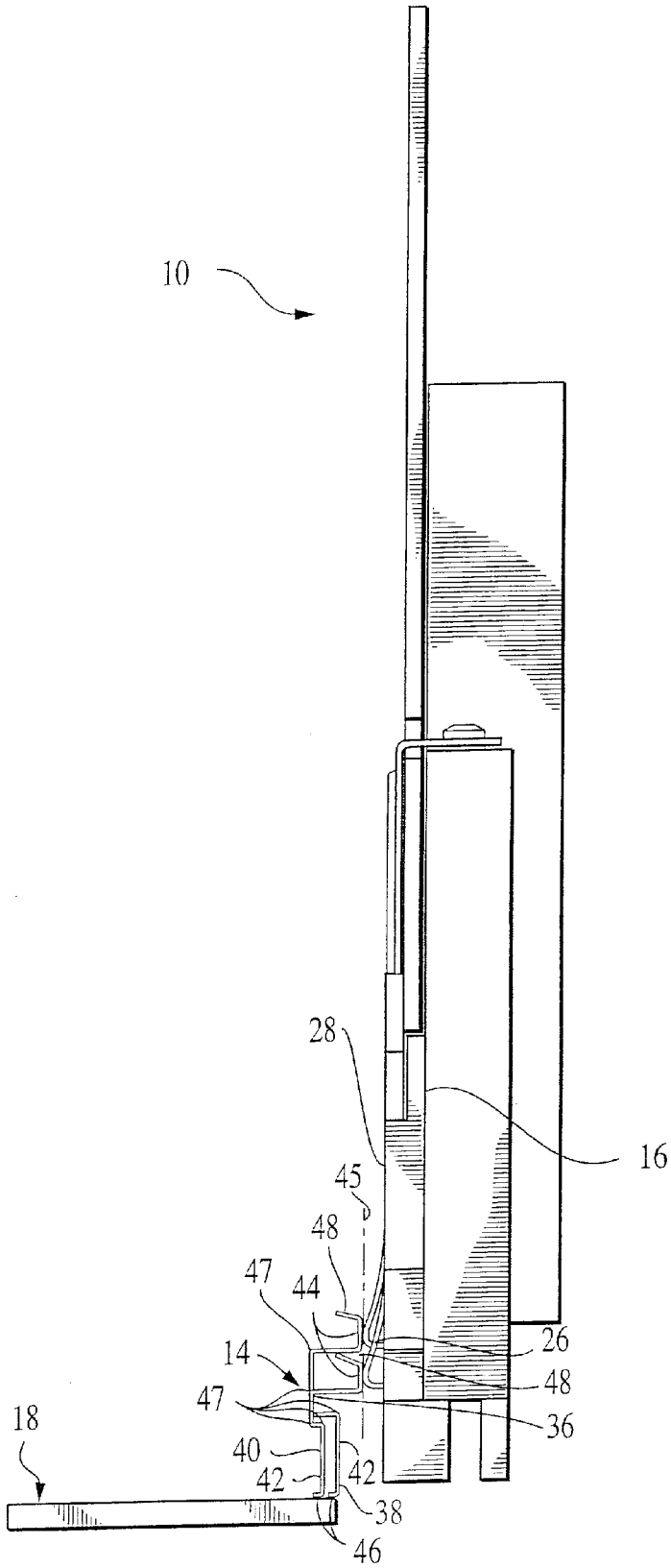
FIG. 2 illustrates a cutaway side view of an electronic cartridge connector assembly and the pen connector in more detail.

FIG. 2 illustrates a cutaway side view of the printer cartridge connector assembly 10 and the pen connector 14 in more detail. The pen connector 14 in FIG. 2 is cut away to show short and long pen contacts 38 and 40 which are thin strips that carry power and data signals between the printer connector 16 and the pen substrate 18. The short and long pen contacts 38 and 40 are formed in segments that include contact stems 42 joined on one end with contact pads 44 and on the opposite end with tail ends 46. The contact pads 44 are joined with retention beams 48. The contact stems 42 are encased within the pen connector 14 and extend along short and long stem planes containing contact stems 42 of the short and long pen contacts 38 and 40, respectively. The contact pads 44 are rectangular in shape and are formed integral with, and extend wider than, the contact stems 42 of the short and long pen contacts 38 and 40. The contact pads 44 are aligned with one another in a contact pad plane 45. The contact pads 44 electrically engage the spring contacts 26 of the printer connector 16. The tail ends 46 represent short strips that are formed integral with, and extend generally perpendicularly from, the contact stems 42. The tail ends 46 are soldered to corresponding traces on the top of the pen substrate 18. The tail ends 46 of the short and long pen contacts 38 and 40 extend along first and second lines, respectively, aligning with corresponding rows of traces on the pen substrate 18. The retention beams 48 are short flat strips that are formed integral with, and extend perpendicularly away from, the contact pads 44. The retention beams 48 retain the contact pads 44 and contact stems 42 within the pen connector 14.

The short and long pen contacts 38 and 40 are formed with bends 47 between the planar contact pads 44 and the contact stems 42. The short pen contacts 38 have a raised rear portion 36 aligned in the long stem plane in order to accommodate placement and retention of the short pen contacts 38 within the pen connector 14. The short and long pen contacts 38 and 40 are aligned above and generally perpendicularly to the top surface 35 with the tail ends 46 soldered to traces on the top surface 35. The short and long pen contacts 38 and 40 are aligned generally parallel to the printer connector side edges 28 so that the contact pads 44 of the short pen contacts 38 and the long pen contacts 40 touch the spring contacts 26 of the printer connector 16.

Figure 3:
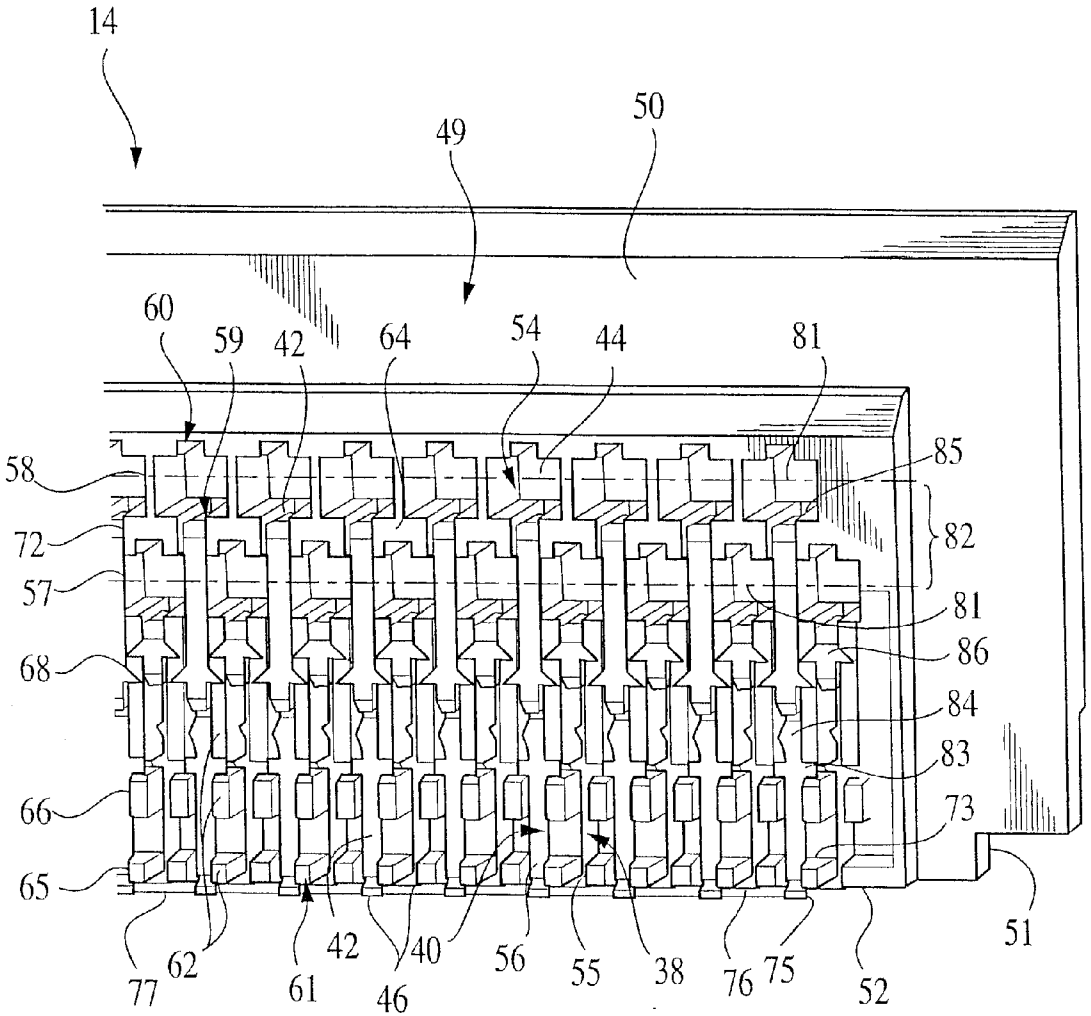
FIG. 3 illustrates a rear isometric view of the pen connector in accordance with an embodiment of the present invention.

FIG. 3 illustrates a rear isometric view of the configuration of the pen connector 14 in accordance with an embodiment of the present invention. The pen connector 14 includes a generally rectangular pen housing 49. The pen housing 49 includes a rear surface 50, a front surface 51, and a bottom edge 52. When the pen connector 14 is positioned generally parallel to the printer connector 16 (FIGS. 1 and 2) within the printer cartridge connector assembly 10 (FIGS. 1 and 2), the pen housing 49 is oriented so that the rear surface 50 faces away from the printer connector 16 and is generally perpendicular to the top surface 35 of the pen substrate 18 (FIGS. 1 and 2).

The pen housing 49 includes short and long retention channels 55 and 56 that are provided in the rear surface 50 and that extend perpendicularly upward from the bottom edge 52 of the pen housing 49. The short and long retention channels 55 and 56 extend parallel to each other. The short retention channels 55 receive the short pen contacts 38 and long retention channels 56 receive the long pen contacts 40. The short and long retention channels 55 and 56 include generally square housing apertures 54 that are wider than the short and long retention channels 55 and 56 and that extend through the pen housing 49 from the rear surface 50 to the front surface 51. The housing apertures 54 are generally the same size and shape as, and receive, the contact pads 44. The housing apertures 54 associated with the short retention channels 55 are aligned with each other in a first housing aperture row 57 generally parallel to the bottom edge 52. The housing apertures 54 associated with the long retention channels 56 are aligned with each other in a second housing aperture row 58 generally parallel to the bottom edge 52. The first housing aperture row 57 is closer to the bottom edge 52 than, and is offset with respect to, the second housing aperture row 58 to afford a compact contact pattern.

The housing apertures 54 include rectangular stem cavities 59 and rectangular beam cavities 60. The stem cavities 59 extend out of the housing apertures 54 toward the bottom edge 52. The beam cavities 60 extend out of the housing apertures 54 away from the bottom edge 52. The beam cavities 60 and the stem cavities 59 are located opposite each other across the housing apertures 54 and are both generally as wide as the short and long retention channels 55 and 56. The stem cavities 59 aid in the insertion and retention of the contact pads 44 into the housing apertures 54 by providing space for the contact stems 42 to enter the housing apertures 54 and be retained within the housing apertures 54. The beam cavities 60 aid in the insertion and retention of the contact pads 44 by providing space for the retention beams 48 (FIG. 2) to enter the housing apertures 54 and be retained within the housing apertures 54. The beam cavities 60 further include rectangular beam walls (not shown) that frictionally engage the retention beams 48. The beam walls include retention ledges (not shown) that press against the retention beams 48 and resist any forces that may push the retention beams 48 in the direction toward the rear surface 50.

The short and long retention channels 55 and 56 include generally rectangular retention walls 61 that are formed integral with, and extend perpendicularly away from, the rear surface 50 of the pen housing 49. The retention walls 61 extend parallel to each other from the bottom edge 52 across portions of the rear surface 50 alongside the short and long retention channels 55 and 56. The retention walls 61 are not continuous; rather the retention walls 61 consist of separated rectangular wall segments 62. More specifically, the wall segments 62 are parallel to each other across the rear surface 50 so as to form wall segment rows. The pen housing 49 also includes generally rectangular retention blocks 64 that are formed integral with, and extend perpendicularly away from, the rear surface 50 of the pen housing 49 and that partially enclose the housing apertures 54. The pen housing 49 includes a first row 65, a second row 66, a third row 68 of wall segments 62, and a fourth row 72 of retention blocks 64. The rows extend parallel to each other and perpendicularly outward from the rear surface 50 proximate the bottom edge 52. The rows are aligned across the rear surface 50 with the first row 65 closest to the bottom edge 52. The wall segments 62 retain the short and long pen contacts 38 and 40 within the pen housing 49, and the retention blocks 64 specifically retain the long pen contacts 40 within the pen housing 49.

The pen housing 49 includes generally rectangular elevated supports 73 that are formed integral with, and extend outward from, the rear surface 50 of the pen housing 49 within the long retention channels 56. The elevated supports 73 generally extend perpendicularly from the rear surface 50 and do not extend between the first row 65 and the second row 66 where the long pen contacts 40 are suspended over the long retention channels 56. The elevated supports 73 retain the long pen contacts 40 so that the tail ends 46 of the long pen contacts 40 are situated above the tail ends 46 of short pen contacts 38.

The elevated supports 73 thus maintain the tail ends 46 of the long pen contacts 40 in a first tail end row 75. The short pen contacts 38 are situated below the long pen contacts 40 in the short retention channels 55 so that the tail ends 46 of the short pen contacts 38 form a second tail end row 76. Thus the contact pads 44 of the long pen contacts 40 retained in the second housing aperture row 58 correspond to and are perpendicular to the tail ends 46 of the long pen contacts 40 retained in the first tail end row 75 and the second housing aperture row 58 corresponds to the first tail end row 75. Likewise, the contact pads 44 of the short pen contacts 38 retained in the first housing aperture row 57 correspond to and are perpendicular to the tail ends 46 of the short pen contacts 38 retained in the second tail end row 76 and thus the first housing aperture row 57 corresponds to the second tail end row 76.

The tail ends 46 extend perpendicularly upward and away from the contact stems 42 when retained in the short and long retention channels 55 and 56, so the tail ends 46 are aligned in a tail end plane 77 that is perpendicular to the rear surface 50. The first tail end row 75 and the second tail end row 76 include tail end centerlines (not shown) that are spaced apart by a first distance (not shown). The contact pads 44 are aligned in the contact pad plane 45 (FIG. 2) along the front surface 51 that is perpendicular to the tail end plane 77. The first housing aperture row 57 and the second housing aperture row 58 include housing centerlines 81 that are spaced apart by a second distance 82 that differs from the first distance.

The short and long pen contacts 38 and 40 include rounded retention prongs 83 that are formed integral with, and extend perpendicularly from, the contact stems 42 so as to cross the contact stems 42. When the short and long pen contacts 38 and 40 are positioned within the short and long retention channels 55 and 56, respectively, of the pen housing 49, the retention prongs 83 frictionally engage the wall segments 62 of the second row 66 and the wall segments 62 of the third row 68 and thus hold the short and long pen contacts 38 and 40 within the short and long retention channels 55 and 56, respectively, and the tail end plane 77 maintain the coplanarity of the tail ends 46.

The short and long pen contacts 38 and 40 include diamond retention barbs 84 that are formed integral with, and extend perpendicularly from, the contact stems 42 so as to widen the contact stems 42. When the short and long pen contacts 38 and 40 are positioned within the short and long retention channels 55 and 56, respectively, of the housing 49, the diamond retention barbs 84 frictionally engage the wall segments 62 of the third row 68 and thus retain the contact stems 42 within the short and long retention channels 55 and 56, retain the tail ends 46 in the tail end plane 77, and retain the contact pads 44 in the contact pad plane 45.

The short and long pen contacts 38 and 40 include flared retention barbs 85 that are formed integral with and extend perpendicularly from the contact stems 42 so as to widen the contact stems 42. The flared retention barbs 85 are situated on the bent contact stems 42 so that the flared retention barbs 85 are generally perpendicular to the contact pad plane 45. When the short pen contacts 38 are positioned within the short retention channels 55 of the pen housing 49, the flared retention barbs 85 of the short pen contacts 38 frictionally engage the wall segments 62 of the third row 68. When the long pen contacts 40 are positioned within the long retention channels 56 of the pen housing 49, the flared retention barbs 85 of the long pen contacts 40 frictionally engage the retention blocks 64 of the fourth row 72. The flared retention barbs 85 thus retain the contact stems 42 within the short and long retention channels 55 and 56, retain the tail ends 46 in the tail end plane 77, and retain the contact pads 44 in the contact pad plane 45.

The short and long pen contacts 38 and 40 include triangular insertion aids 86 that are formed integral with, and extend perpendicularly from, the contact stems 42 so as to significantly widen the contact stems 42. When the short and long pen contacts 38 and 40 are positioned within the pen housing 49, the insertion aids 86 rest upon the wall segments 62 of the third row 68. The insertion aids 86 connect the short and long pen contacts 38 and 40 to a carrier strip 89 (FIG. 4) before the short and long pen contacts 38 and 40 are secured to the pen housing 49.

Figure 4:
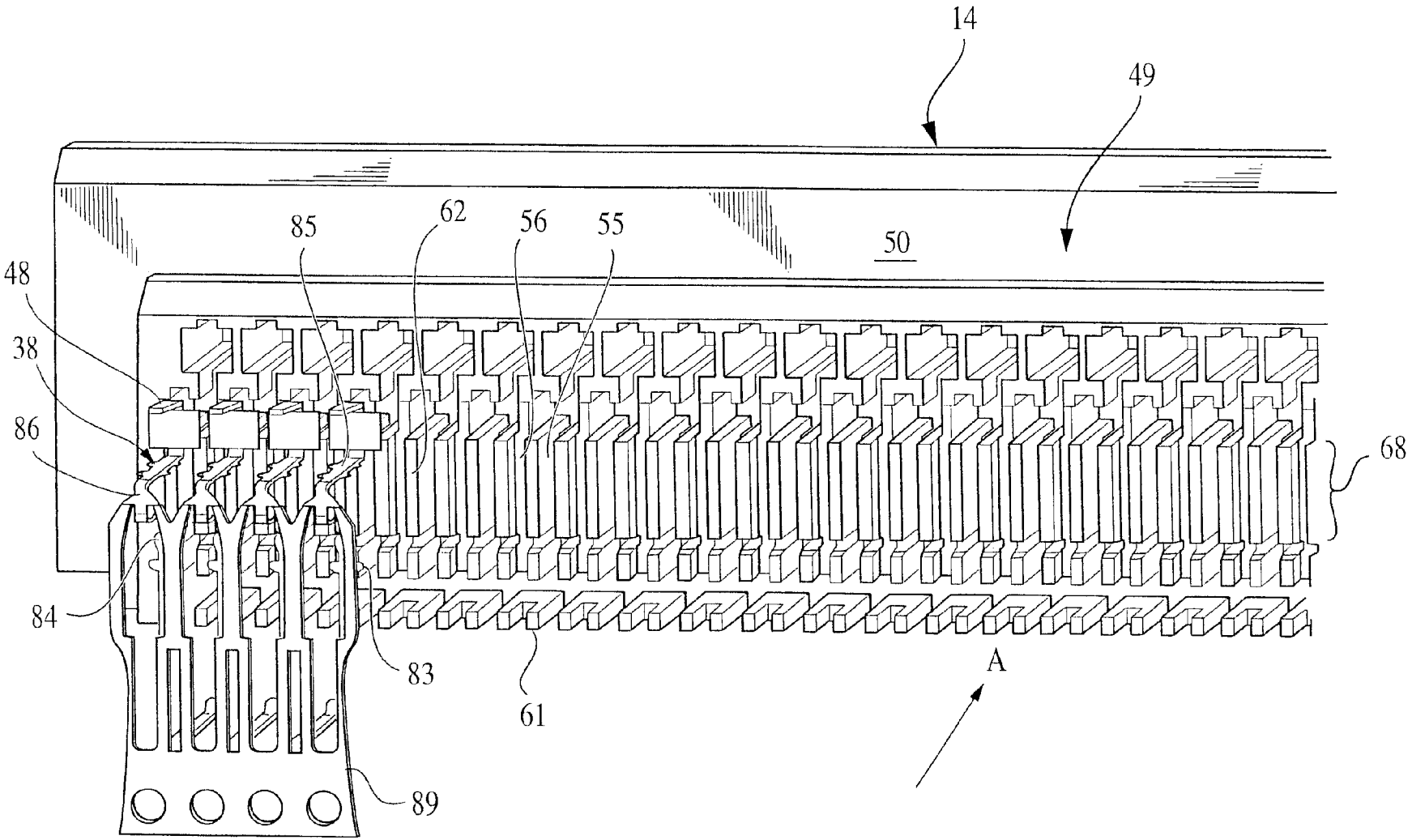
FIG. 4 illustrates an exploded rear isometric view of the pen connector of FIG. 3.

FIG. 4 illustrates an exploded rear isometric view of the pen connector 14 of FIG. 3. The carrier strip 89 is attached to the insertion aids 86 of the short pen contacts 38. The carrier strip 89 is used to load the short pen contacts 38 and long pen contacts 40 (not shown) into the pen housing 49. The short and long pen contacts 38 and 40 are inserted into the pen housing 49 through the rear surface 50 in the direction of arrow A by using a tool (not shown) to position the carrier strip 89 over the rear surface 50 of the pen housing 49. As the insertion aids 86 are positioned on top of the wall segments 62 of the third row 68 and the short and long pen contacts 38 and 40 are positioned into the short and long retention channels 55 and 56, respectively, the retention prongs 83, diamond retention barbs 84, flared retention barbs 85, and retention beams 48 snap into the short and long retention channels 55 and 56 and frictionally engage the retention walls 61, retaining the short and long pen contacts 38 and 40 within the pen housing 49. The carrier strip 89 is then snapped off of the insertion aids 86.

Figure 5:
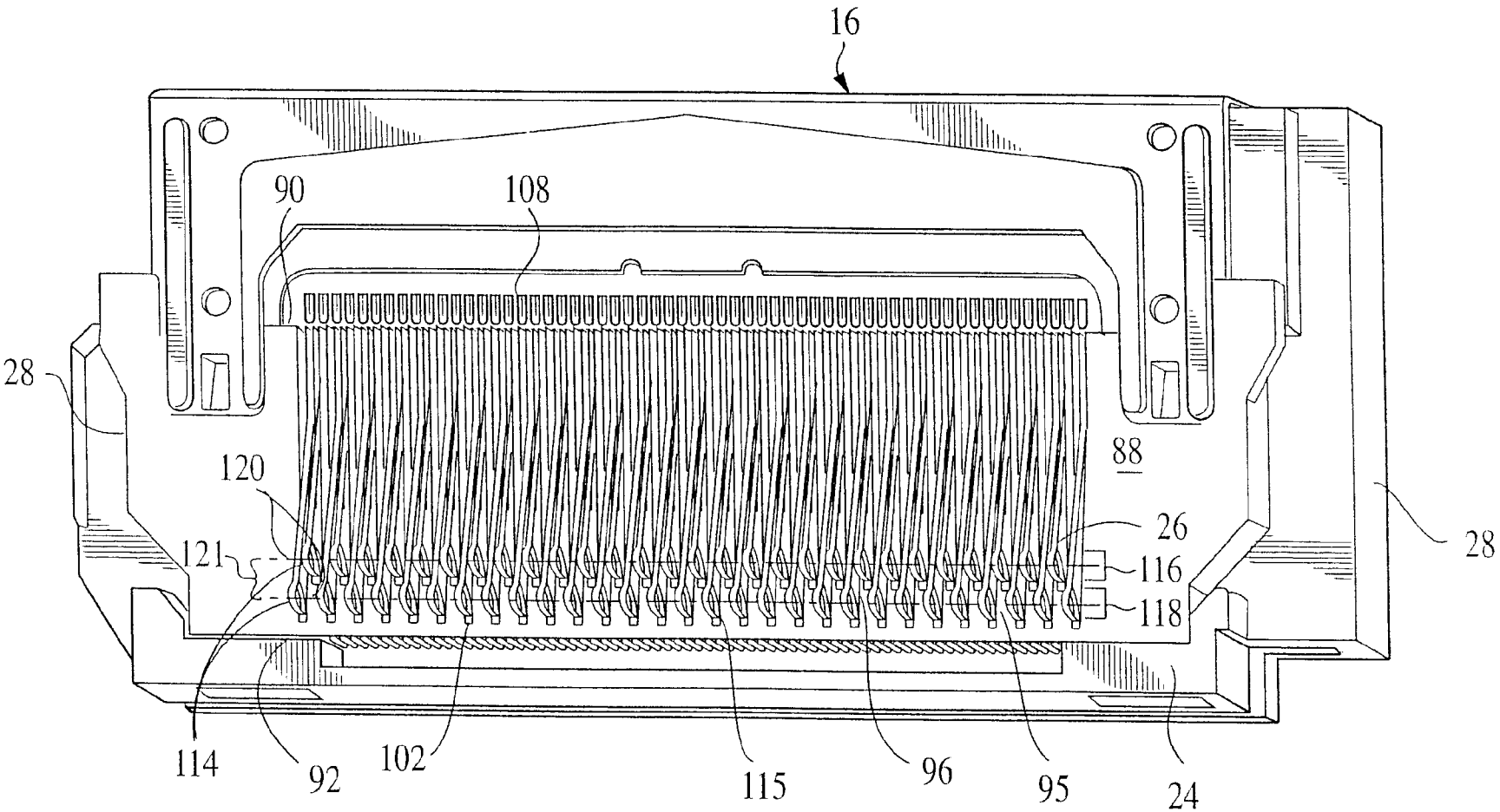
FIG. 5 illustrates an isometric view of the printer connector in accordance with an embodiment of the present invention.

FIG. 5 illustrates an isometric view of the printer connector 16 in accordance with an embodiment of the present invention. A printer housing 24 includes a connector front surface 88, a connector top edge 90, and a connector bottom edge 92. The connector top edge 90 extends across the printer housing 24 perpendicular to the side edges 28 and parallel to the connector bottom edge 92. The printer housing 24 includes spring channels 96 that retain the spring contacts 26. Spring channel walls 95 extending along the spring channels 96 frictionally engage and retain the spring contacts 26.

The printer housing 24 also includes spring recesses (not shown) which extend under the spring channels 96 from the connector bottom edge 92 to generally midway between the connector bottom edge 92 and the connector top edge 90. The spring recesses extend entirely through the printer housing 24 and receive the spring contacts 26 when the spring contacts 26 are deflected into the printer housing 24 by mating contacts.

The deflectable spring contacts 26 include solder tails 108. The solder tails 108 are retained within the spring channels 96 and extend out of the spring channels 96 outward from, and perpendicular to, the connector top edge 90. The solder tails 108 may be soldered to a printer circuit board (not shown) and thus secure the printer connector 16 to the printer circuit board and conduct power and signals from the printer circuit board to the spring contacts 26.

The solder tails 108 include diamond shaped tail barbs (not shown) and rectangular tail flares (not shown). The tail barbs and tail flares are formed integral with, and extend perpendicularly from, the solder tails 108 and retain the solder tails 108 within the printer housing 24 by frictionally engaging the spring channel walls 95.

The spring contacts 26 include spring arches 114 that extend generally perpendicularly outward away from the printer housing 24 at channel ends 102 and that curve in the direction toward the connector top edge 90 and gradually slant back down toward the spring channels 96. The spring arches 114 touch, and conduct electricity to, the contact pads 44 of the pen connector 14 of FIG. 3 when the printer connector 16 and the pen connector 14 are properly aligned with each other. The spring contacts 26 include rectangular spring latches 115 that are formed integral with, and extend perpendicularly from, the spring arches 114 in the direction toward the connector bottom edge 92. The spring latches 115 extend into the spring recesses and under the connector front surface 88. The spring latches 115 are narrower than the spring recesses and are not retained within the spring channels 96. When pressure is applied to the spring arches 114, the solder tails 108 are retained within the printer housing 24 as the spring arches 114 are deflected down into the spring recesses. The deflectability of the spring contacts 26 allows the spring arches 114 to be pressed up against the contact pads 44 without damaging the contact pads 44 or the spring contacts 26.

The spring arches 114 are aligned to form a first spring arch row 116 and a second spring arch row 118. The first spring arch row 116 and the second spring arch row 118 are parallel to each other and to the connector bottom edge 92 with the second spring arch row 118 being located closer to the connector bottom edge 92. The first spring arch row 116 and the second spring arch row 118 include centerlines 120. The centerlines 120 are separated by a distance 121 that is equal to the second distance 82 separating the housing centerlines 81 of the first housing aperture row 57 and the second housing aperture row 58 of FIG. 3. Thus the contact pads 44 are aligned in rows spaced identically to the rows of spring contacts 26 so that when the printer connector 16 and pen connector 14 properly interface each other, the contact pads 44 touch corresponding spring contacts 26.

The printer connector 16 of FIG. 5 and the rear loaded pen connector 14 of FIGS. 3 and 4 yield several benefits when used in an electronic cartridge connector assembly 10. First, the pen connector 14 contains two functional perpendicular surfaces (the contact pads 44 and soldered tail ends 46) that may be used in a typical printer cartridge connector assembly to connect the printer connector 16 to the generally perpendicular pen substrate 18. Additionally, because the housing aperture rows 57 and 58 and the first and second tail end rows 75 and 76 are separated by different distances, the pen connector 14 includes two independent contact row patterns that are perpendicular to each other. The independent and perpendicular row patterns permit greater versatility in aligning the pen connector 14 between the printer connector 16 and the pen substrate 18.

Secondly, the pen connector 14 includes only the pen housing 49 and the short and long pen contacts 38 and 40, so the pen connector 14 does not take up a large amount of space nor does the pen connector 14 run a large risk of component failure. The pen connector 14 does not include any intricate wiring or expensive film. The pen connector 14 is also easy to assemble. The short and long pen contacts 38 and 40 may simply be snapped into the pen housing 49 from the rear by use of the carrier strip 89 attached to the insertion aids 86. The retention beams 48 and the retention barbs 84 and 85 of the short and long pen contacts 38 and 40 hold the short and long pen contacts 38 and 40 in the pen housing 49 and ensure that the tail ends 46 of the short and long pen contacts 38 and 40 are aligned along the tail end plane 77 so that the tail ends 46 may easily be soldered to the pen substrate 18. Also, assembling the pen connector 14 does not involve any time-consuming wire bonding.

Finally, the printer connector 16 similarly only includes the spring contacts 26 and the printer housing 24, so the printer connector 16 does not take up a large amount of space nor does the printer connector 16 run a large risk of component failure. The printer connector is also easy to assemble by sliding the spring contacts 26 into the printer housing 24.

Figure 6:
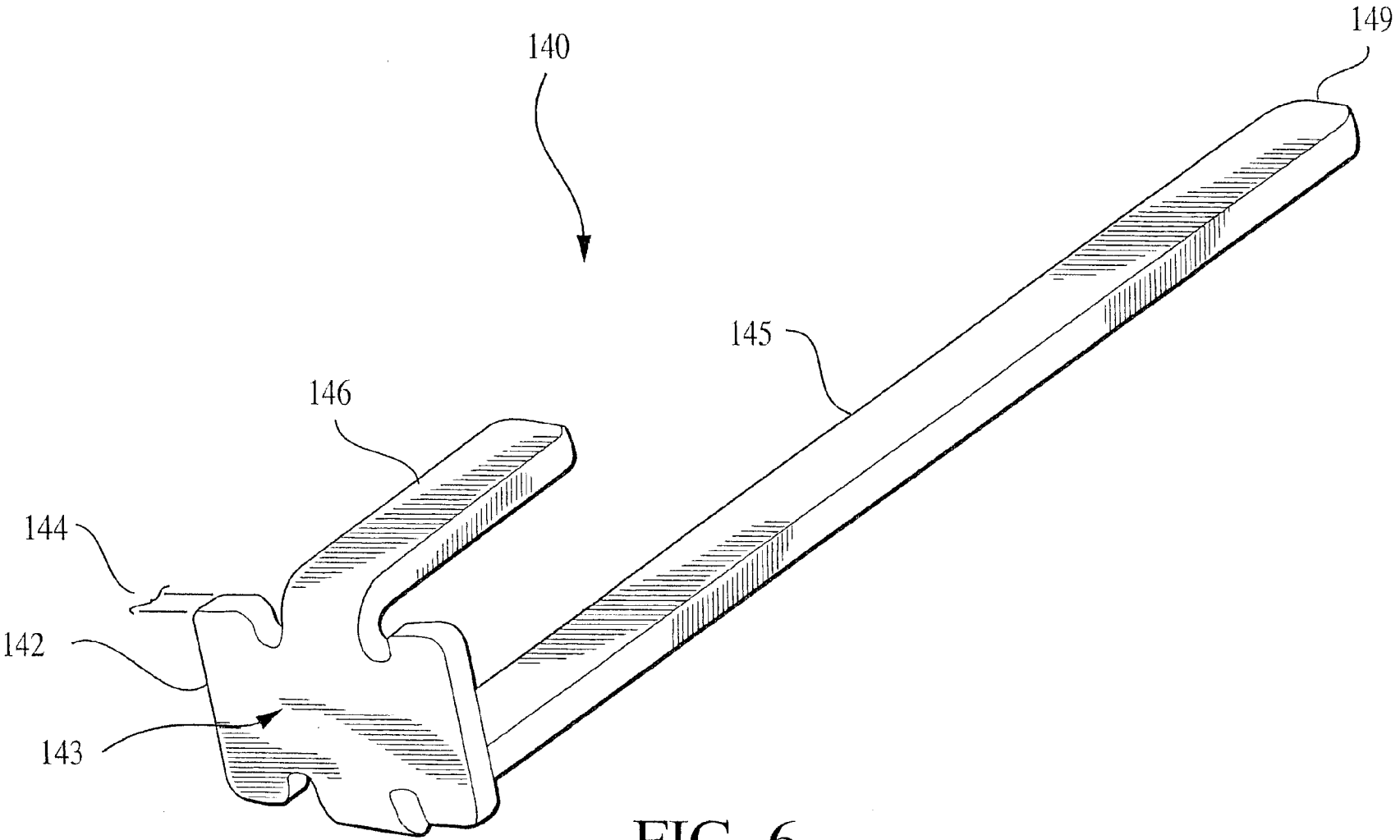
FIG. 6 illustrates an isometric view of a front load pen contact formed in accordance with an alternative embodiment of the present invention.

FIG. 6 illustrates an isometric view of a front load pen contact 140 formed in accordance with an alternative embodiment of the present invention. The pen contact 140 as shown is to be inserted into a front load pen connector 150 (FIG. 7) and bent around the front load pen connector 150. The pen contact 140 includes a generally square contact pad 142, a bendable, rectangular contact stem 145, a bendable, rectangular retention latch 146, and a tail end 149. The contact pad 142 includes a pad top surface 143 and a pad thickness 144. The contact stem 145 and retention latch 146 are formed integral with, and extend perpendicularly downward and away from, the contact pad 142. The contact stem 145 and the retention latch 146 retain the pen contact 140 within the front load pen connector 150. The tail end 149 is soldered to the pen substrate 18 from FIGS. 1 and 2 to connect the pen contact 140 to the pen substrate 18. The contact stem 145 and contact pad 142 conduct electricity from the spring contacts 26 of FIGS. 1 and 2 to the pen substrate 18.

Figure 7:
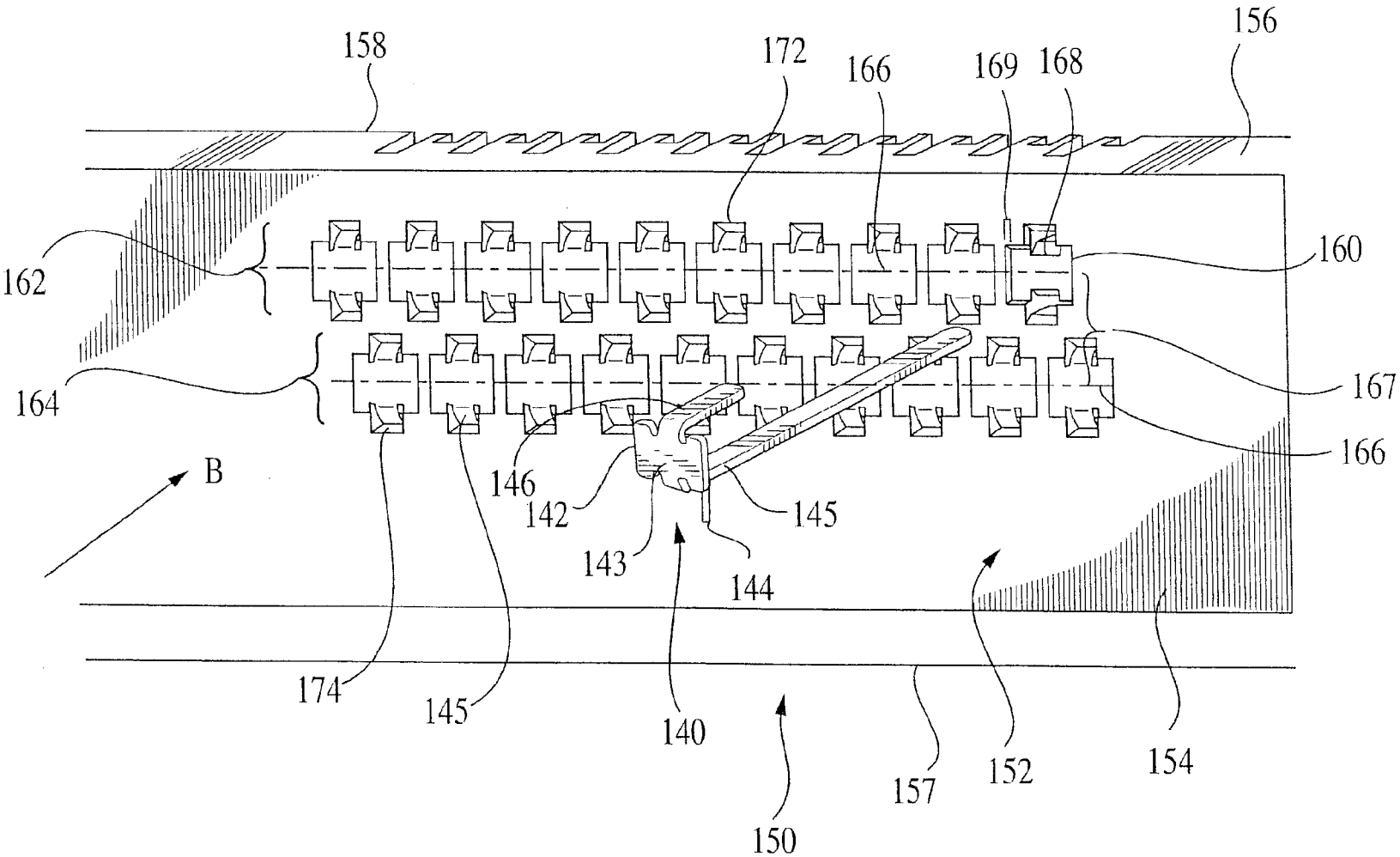
FIG. 7 illustrates an isometric front view of the front load pen contact and a front load pen connector formed in accordance with an alternative embodiment of the present invention.

FIG. 7 illustrates a front isometric view of the pen contact 140 and a front load pen connector 150 formed in accordance with an alternative embodiment of the present invention. The front load pen connector 150 includes a generally rectangular front load housing 152. The front load housing 152 includes a front surface 154, a top surface 156, a bottom surface 157, and a rear surface 158. The top surface 156 and bottom surface 157 are parallel to each other.

The front surface 154 includes generally square shaped housing recesses 160 that are aligned parallel to each other and the top surface 156 in a first recess row 162 and a second recess row 164. The first recess row 162 is located between the top surface 156 and the second recess row 164. The first recess row 162 and the second recess row 164 both have centerlines 166 that are separated by a distance 167. The housing recesses 160 have recess floors 168 that define a recess depth 169 of the housing recesses 160 as measured from the recess floors 168 to the front surface 154. The recess depth 169 is generally equal to the pad thickness 144. The housing recesses 160 retain the contact pads 142 so that the pad top surfaces 143 remain generally aligned with the front surface 154.

The housing recesses 160 include rectangular latch cavities 172 that extend from the housing recesses 160 in the direction toward the top surface 156. The housing recesses 160 also include stem cavities 174 that extend from the housing recesses 160 in the direction toward the bottom surface 157. The latch cavities 172 and stem cavities 174 are wider than the retention latches 146 and contact stems 145, respectively, and allow for the insertion of the retention latches 146 and contact stems 145 into the front load housing 152. Both the latch cavities 172 and the stem cavities 174 extend through the front load housing 152 from the front surface 154 to the rear surface 158 and help retain the pen contacts 140 within the front load housing 152.

The pen contacts 140 are inserted into the front load housing 152 through the front surface 154 by positioning the pen contacts 140 in the direction of arrow B so that the contact stems 145 are aligned with and enter the stem cavities 174 and the retention latches 146 are aligned with and enter the latch cavities 172. The pen contacts 140 are fully inserted when the contact pads 142 touch the recess floors 168.

Figure 8:
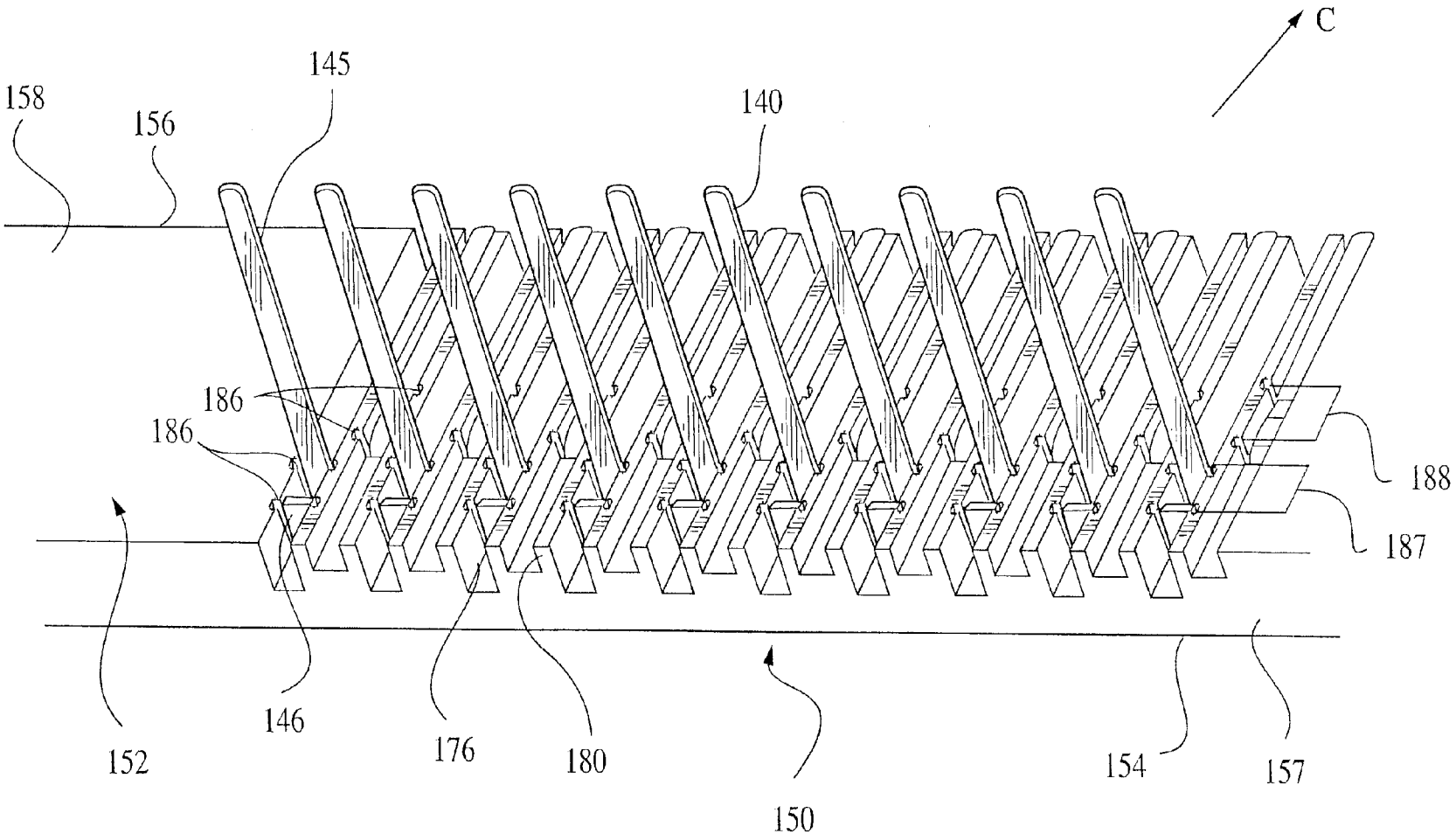
FIG. 8 illustrates a rear isometric view of the front load pen connector of FIG. 7 with partially and fully-loaded front load pen contacts.

FIG. 8 illustrates a rear isometric view of the front load pen connector 150 with partially and fully-loaded front load pen contacts 140. The front load housing 152 includes rectangular retention channels 176 that extend perpendicularly from the top surface 156 to the bottom surface 157. The retention channels 176 retain the retention latches 146 and contact stems 145 after the retention latches 146 and contact stems 145 have been fully inserted through the front surface 154 and positioned into the retention channels 176.

The front load housing 152 includes rectangular support walls 180 that extend perpendicularly from the top surface 156 to the bottom surface 157, enclosing the retention channels 176. The support walls 180 may frictionally engage and retain the retention latches 146 and the contact stems 145 when the retention latches 146 and the contact stems 145 are positioned into the retention channels 176.

The support walls 180 include rectangular through notches 186 that are aligned perpendicularly to the support walls 180. The through notches 186 correspond to the latch cavities 172 (FIG. 7) and stem cavities 174 (FIG. 7) that pass through the front load housing 152. Thus, when the retention latches 146 and contact stems 145 are inserted through the latch cavities 172 and stem cavities 174, respectively, the retention latches 146 and contact stems 145 are positioned within the through notches 186. The through notches 186 are aligned across the rear surface 158 in a first row 187 corresponding to the latch cavities 172 and the stem cavities 174 of the first recess row 162 (FIG. 7) and a second row 188 corresponding to the latch cavities 172 and the stem cavities 174 of the second recess row 164 (FIG. 7).

Once the contact stems 145 and retention latches 146 are passed through the stem cavities 174 and latch cavities 172, respectively, and the through notches 186, the contact stems 145 and retention latches 146 are bent generally ninety degrees in the direction of arrow C out of the through notches 186 and into the retention channels 176 so that the retention latches 146 and contact stems 145 are frictionally engaged by the support walls 180. Alternatively, the contact stems 145 and retention latches 146 are clinched and do not need to engage the support walls 180.

Figure 9:
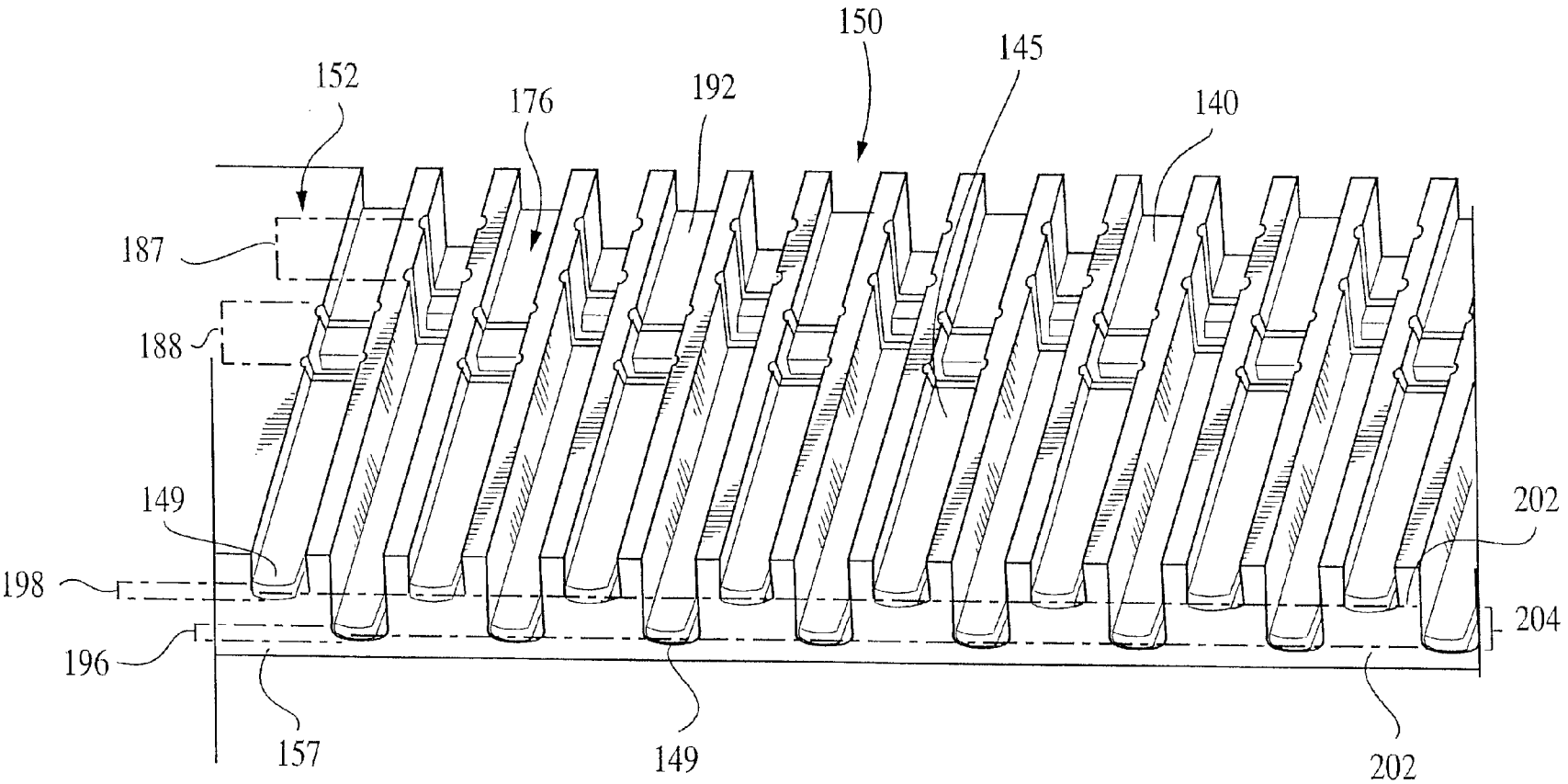
FIG. 9 illustrates a rear isometric view of the front load pen connector with the front load pen contacts bent to a final position.

FIG. 9 illustrates a rear isometric view of the front load pen connector 150 with the pen contacts 140 bent to a final position. The front load housing 152 includes rectangular shallow channel bases 192 that extend across the retention channels 176 and retain the contact stems 145 that are inserted through the second row 188 in a first contact stem row 198. The contact stems 145 that are inserted through the first row 187 are retained in the retention channels 176 in a second contact stem row 196. The first contact stem row 198 and the second contact stem row 196 have centerlines 202 that are separated by a distance 204. The distance 167 (FIG. 7) is different from distance 204.

The tail ends 149 of the pen contacts 140 extend out of the retention channels 176 away from the front load housing 152 perpendicular to the bottom surface 157. The tail ends 149 are then all bent so that the tail ends 149 are all aligned in a tail end plane 201 (FIG. 10) that is generally perpendicular to the front surface 154. When the tail ends 149 are aligned in the tail end plane 201, the tail ends 149 may be easily soldered to the pen substrate 18 (FIGS. 1 and 2).

Figure 10:
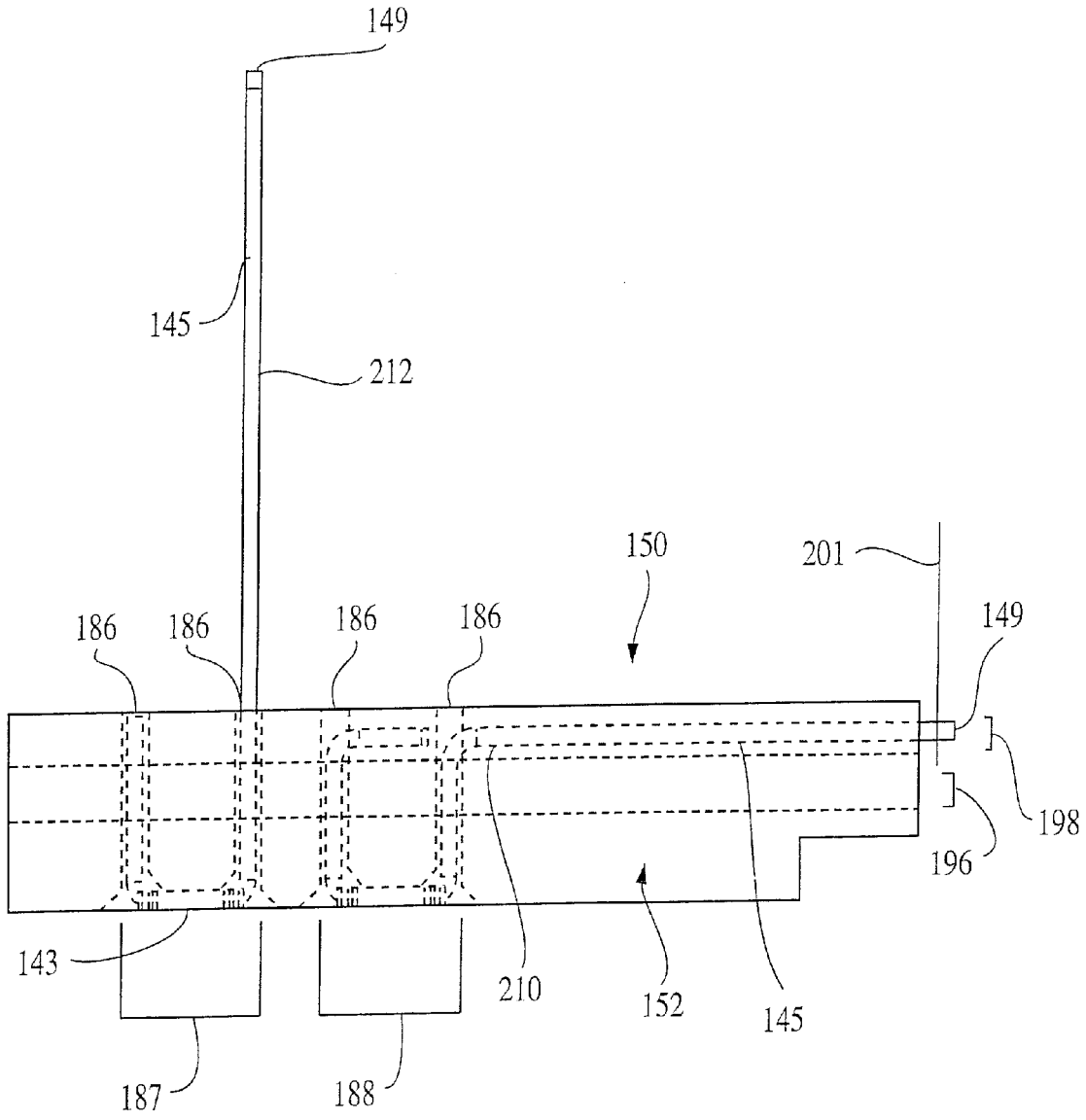
FIG. 10 illustrates a hidden line view of an end section of the front load pen.

FIG. 10 illustrates a hidden line view of an end section of the front load pen connector 150. The front load pen connector 150 includes a bent pen contact 210 and an unbent pen contact 212. The bent pen contact 210 has been inserted into the through notches 186 in the second row 188 and has been bent so that the contact stem 145 is in the first contact stem row 198. The unbent pen contact 212 has been inserted into the through notches 186 in the first row 187. When the unbent pen contact 212 is bent and retained within the second contact stem row 196, the tail ends 149 of the bent pen contact 210 and the unbent pen contact 212 may then be bent so as to be aligned in the tail end plane 201.

Like the embodiment of the present invention shown in FIG. 5, a carrier strip (not shown) may be used to insert the pen contacts 140 into the front load pen connector 150. The carrier strip is connected to the pen contacts 140 along the pad top surfaces 143 and may be snapped off of the pad top surfaces 143 after the pen contacts 140 have been inserted into the front load housing 152.

The front load pen connector 150 provides a number of benefits when used with an electronic cartridge connector assembly 10. First, the front load pen connector 150 includes all of the benefits regarding perpendicular alignment, row distance, and component simplicity described above for the rear load pen connector 14, and the front load pen connector 150 may be used to interface with the printer connector 16 described above. Secondly, the J-shape of the unbiased pen contact 140 allows for the pen contacts 140 to be inserted into the front load housing 152 without the use of insertion aids or retention barbs. Also, because the pen contacts 140 are retained within the front load housing 152 by being bent around the front load housing 152, the pen contacts 140 do not need to be snapped into the front load housing 152 nor do the pen contacts 140 risk being snapped out of the front load housing 152. Finally, the tail ends 149 may conveniently be soldered to the pen substrate 18 of FIGS. 1 and 2 because all of the tail ends 149 are bent together into alignment within the tail end plane 201.

Figure 11:
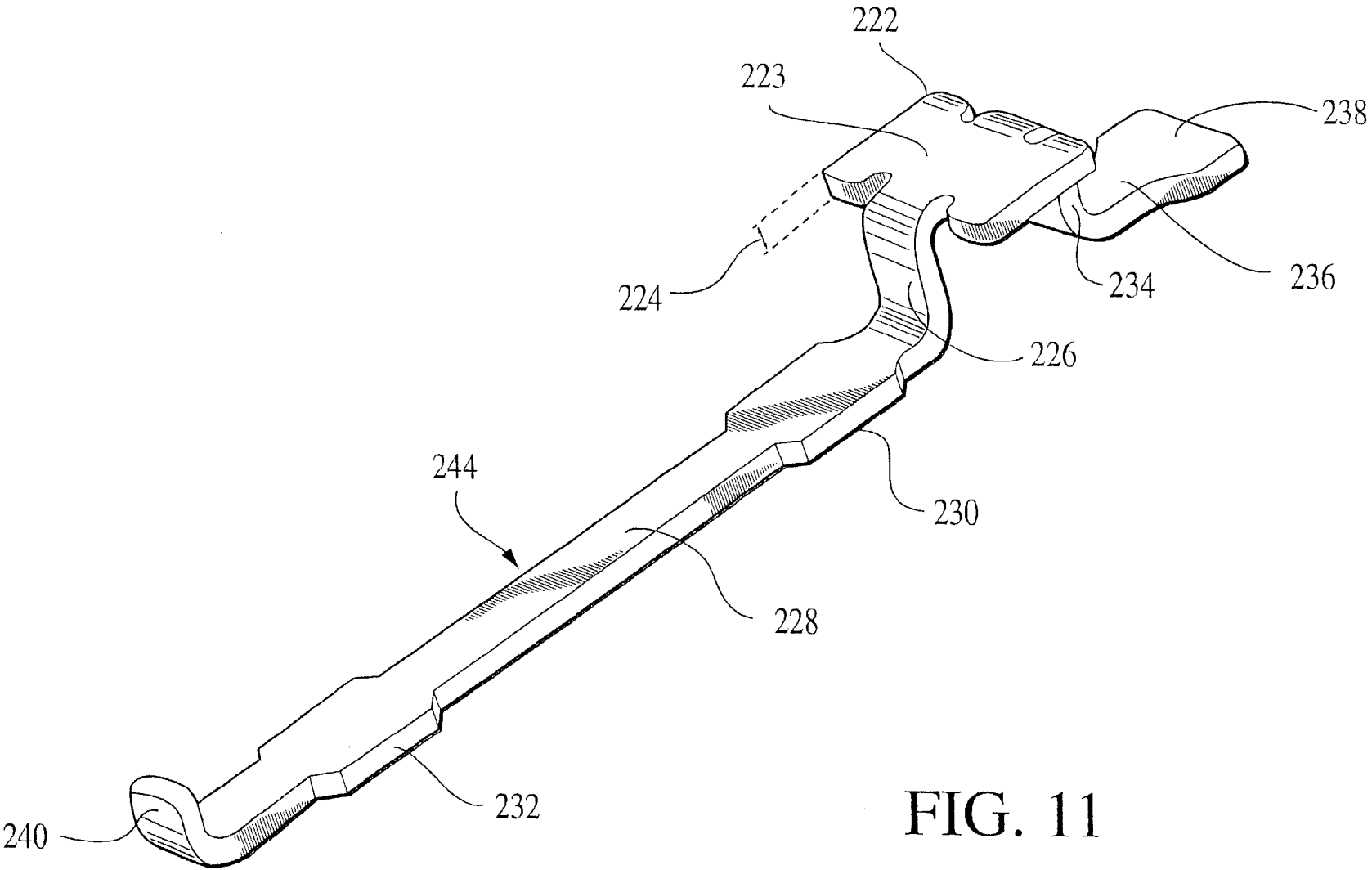
FIG. 11 illustrates an isometric view of a top load short pen contact formed in accordance with an alternative embodiment of the present invention.
Figure 12:
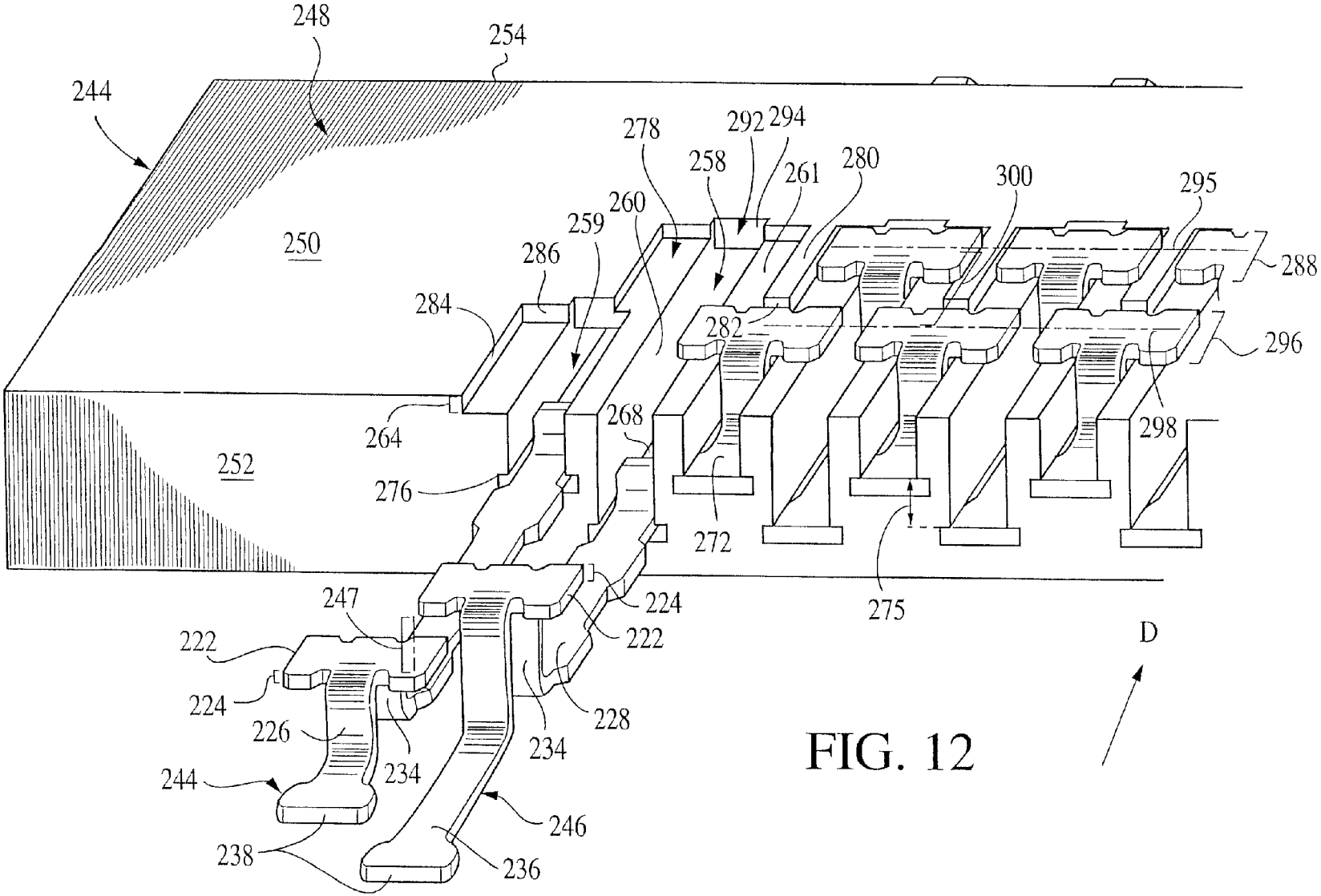
FIG. 12 illustrates an isometric view of a top load pen connector and two partially-loaded pen contacts formed in accordance with an alternative embodiment of the present invention.

FIG. 11 illustrates an isometric view of a top load short pen contact 244 formed in accordance with an alternative embodiment of the present invention. The short pen contact 244 as shown is to be slidably inserted into a top load pen connector 242 (FIG. 12). The short pen contact 244 includes a generally square contact pad 222, a rectangular stem segment 226, a rectangular contact stem 228, rectangular first and second retention flares 230 and 232, a latch segments 234, a retention latch 236, and a tail end 240. The contact pad 222 conducts electricity from one of the spring contacts 26 of FIGS. 1 and 2 through the short pen contact 244. The contact pad 222 includes a pad top surface 223 and a pad thickness 224. The stem segment 226 and latch segments 234 are formed integral with, and extend perpendicularly downward from, the contact pad 222. The contact stem 228 is formed integral with, and extends perpendicularly away from, the stem segment 226.

The first and second retention flares 230 and 232 are formed integral with, and extend perpendicularly from, the contact stem 228 and retain the short pen contact 244 within the top load pen connector 242. The retention latch 236 is formed integral with, and extends perpendicularly away from, the latch segments 234. The retention latch 236 includes a generally triangular retention barb 238 that is formed integral with, and that extends perpendicularly from, the retention latch 236 and retains the short pen contact 244 within the top load pen connector 242. The tail end 240 is formed integral with, and extends perpendicularly upward from, the contact stem 228. When the short pen contact 244 is inserted into the top load pen connector 242, the tail end 240 is soldered to the pen substrate 18 from FIGS. 1 and 2.

FIG. 12 illustrates an isometric view of a top load pen connector 242, partially-loaded short pen contact 244, and a partially-loaded tall pen contact 246 formed in accordance with an alternative embodiment of the present invention. The contact pads 222 of the tall pen contacts 246 are higher above the contact stems 228 and the retention latches 236 than the contact pads 222 of the short pen contacts 244 by a distance 247.

The top load pen connector 242 includes a generally rectangular top load housing 248. The top load housing 248 includes a front surface 250 a top surface 252, and a bottom surface 254. The top load housing 248 also includes alternately aligned deep retention channels 258 and shallow retention channels 259 that receive and retain the tall pen contacts 246 and the short pen contacts 244, respectively.

The deep and shallow retention channels 258 and 259 include rectangular support walls 260 that enclose the stem segments 226 and latch segments 234 of the inserted short and tall pen contacts 244 and 246. The support walls 260 include rectangular wall top surfaces 261 that are aligned below the front surface 250 by a wall top surface depth 264 generally equal to the pad thickness 224. Thus, the wall top surfaces 261 support the inserted contact pads 222 so that the contact pads 222 are exposed to and touch the spring contacts 26 of the printer connector 16 of FIG. 5.

The deep and shallow retention channels 258 and 259 also include deep channel bases 268 and shallow channel bases 272. The deep channel bases 268 are located further below the front surface 250 than the shallow channel bases 272 by a distance 275 that is generally equal to the distance 247. The tall pen contacts 246 and the short pen contacts 244 are slidably inserted into the deep retention channels 258 and the shallow retention channels 259, respectively, in the direction of arrow D.

The deep and shallow retention channels 258 and 259 also include rectangular parallel retention slots 276 extending into the support walls 260 from the top surface 252 to the bottom surface 254. The short and tall pen contacts 244 and 246 are slidably inserted into the top load housing 248 so that the retention barbs 238 enter and frictionally engage the retention slots 276 and are retained within the retention slots 276.

The front surface 250 includes generally square shaped housing recesses 278. The housing recesses 278 are enclosed and separated from each other by rectangular housing strips 280. The housing strips 280 include rectangular resistance ends 282 that face in the same direction as the top surface 252 and that contact and resist the latch segments 234 of the inserted short pen contacts 244. The housing strips 280 also include rectangular side housing walls 284 that are perpendicular to rectangular rear housing walls 286. The side housing walls 284 and rear housing walls 286 enclose and retain the contact pads 222 of tall pen contacts 246 when the tall pen contacts 246 are slidably inserted into the top load housing 248.

The housing recesses 278 include rectangular retention cavities 292 and rectangular resistance walls 294. The retention cavities 292 retain the latch segments 234 of the inserted tall pen contacts 246. The resistance walls 294 resist the progress of the latch segments 234 of the tall pen contacts 246 as the tall pen contacts 246 are slidably inserted toward and against the resistance walls 294. The housing recesses 278 are aligned with each other so that the inserted contact pads 222 of the tall pen contacts 246 form a first contact pad row 288 that is parallel to the top surface 252. The first contact pad row 288 includes a first centerline 295.

As the short pen contacts 244 are slidably inserted into the shallow retention channels 259, the contact pads 222 of the short pen contacts 244 slide along the wall top surfaces 261 until the latch segments 234 of the short pen contacts 244 engage and are resisted by the resistance ends 282 of the housing strips 280. When the latch segments 234 of the short pen contacts 244 are pressed up against the resistance ends 282, the pad top surfaces 223 of the short pen contacts 244 are aligned in a second contact pad row 296 that is parallel to the first contact pad row 288. The second contact pad row 296 has a second centerline 298. The first centerline 295 and the second centerline 298 are separated by a distance 300.

Figure 13:
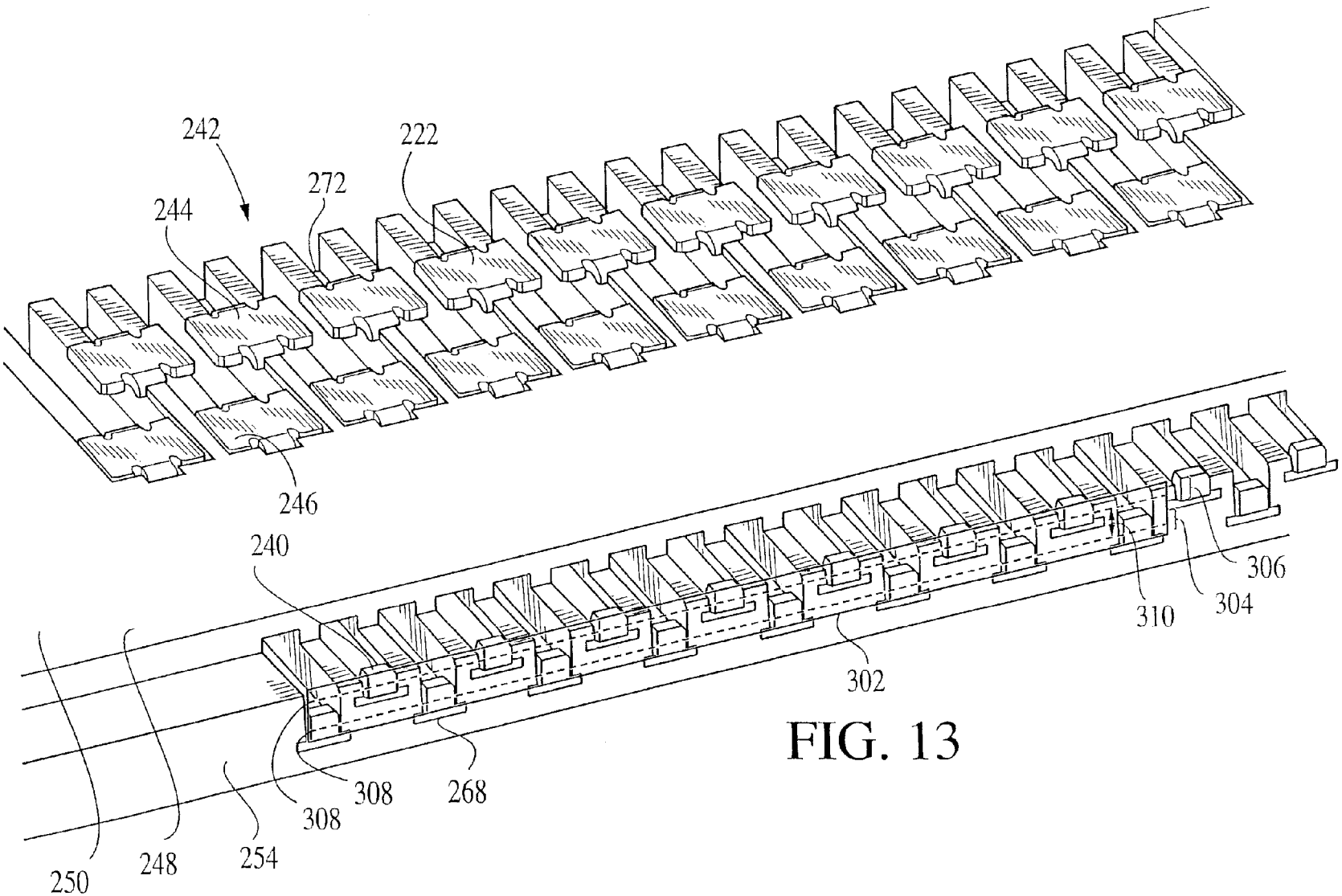
FIG. 13 illustrates a bottom isometric view of the top load pen connector of FIG. 11.

FIG. 13 illustrates a bottom isometric view of the top load pen connector 242 of FIG. 11. When the short and tall pen contacts 244 and 246 are fully inserted into the top load housing 248, the tail ends 240 of both the tall pen contacts 246 and the short pen contacts 244 are positioned outside of the top load housing 248 perpendicular to, and facing in the same direction as, the bottom surface 254. The tail ends 240 are aligned along a tail end plane 302 that is perpendicular to the front surface 250. Because the tail ends 240 are aligned along a tail end plane 302, the tail ends 240 may be easily soldered to the pen substrate 18 of FIGS. 1 and 2.

The tail ends 240 of the tall pen contacts 246 that are retained in the deep channel bases 268 are aligned in a first tail end row 304. The tail ends 240 of the short pen contacts 244 that are retained in the shallow channel bases 272 are aligned in a second tail end row 306. The second tail end row 306 is parallel to the first tail end row 304 and is situated above the first tail end row 304. The first tail end row 304 and the second tail end row 306 have centerlines 308. The centerlines 308 are separated by a distance 310 that is different from the distance 300 (FIG. 12). Thus the first tail end row 304, which includes the tail ends 240 of the tall pen contacts 246, corresponds to the first contact pad row 288 (FIG. 12), which includes the contact pads 222 of the tall pen contacts 246. Likewise, the second tail end row 306, which includes the tail ends 240 of the short pen contacts 244, corresponds to the second contact pad row 296 (FIG. 12), which includes the contact pads 222 of the short pen contacts 244.

Like the embodiment of the present invention shown in FIG. 5, a carrier strip (not shown) may be used to slidably insert the short and tall pen contacts 244 and 246 into the top load pen connector 242. The carrier strip may be connected to the short and tall pen contacts 244 and 246 along the retention barbs 238 (FIG. 11) and may be snapped off the retention barbs 238 after the short and tall pen contacts 244 and 246 have been inserted into the top load housing 248.

The top load pen connector 242 provides a number of benefits when used with a printer assembly. First, the top load pen connector 242 includes all the benefits regarding perpendicular alignment, row distance, and component simplicity described above for the rear load pen connector 14, and the top load pen connector 242 may be used to interface with the printer connector 16 of FIG. 5. Secondly, the short and tall pen contacts 244 and 246 may be easily slid into the shallow and deep retention channels 259 and 258, respectively, of the top load housing 248 with the retention barbs 238 and the retention flares 230 and 232 sliding into and engaging the retention slots 276. Therefore, the retention barbs 238 and retention flares 230 and 232 do not have to be snapped into the top load housing 248, nor do the short and tall pen contacts 244 and 246 risk being snapped out of the top load housing 248 inadvertently. The tail ends 240 are aligned along the tail end plane 302, so the tail ends 240 may conveniently be soldered to the pen substrate 18 of FIGS. 1 and 2.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electronic cartridge connector assembly comprising:

a housing adapted to be secured to an electronic cartridge; and contacts secured to said housing and adapted for carrying power and data signals from said electronic cartridge, each contact having a tail end adapted to be bounded to a substrate, each contact having a connector pad at an end opposite to said tail ends, said connector pads being adapted to electrically engage mating contacts, said tail ends of said contacts being held by said housing in a first plane arranged in rows spaced apart by a first distance, said connector pads of said contacts being held by said housing in a second plane arranged in rows spaced apart by a second distance, said first distance and said second distance differing from one another.

2. The electronic cartridge connector assembly of claim 1, wherein said first and second planes intersect each other.

3. The electronic cartridge connector assembly of claim 1, wherein said tail ends of said contacts are directly connectable to a surface of a substrate through reflow soldering.

4. The electronic cartridge connector assembly of claim 1, wherein said tail ends are arranged in at least first and second rows having respective first and second center lines spaced apart by said first distance.

5. The electronic cartridge connector assembly of claim 1, wherein said connector pads are arranged in at least first and second rows having respective first and second center lines spaced apart by said second distance.

6. The electronic cartridge connector assembly of claim 1, wherein each contact includes a stem portion extending from said tail end to said connector pad, said stem portion including a flared retention barb having a width greater than a width of said stem portion, said flared retention barb frictionally engaging said housing to retain a corresponding connector pad in said second plane in order to resist normal forces experienced by said corresponding connector pad from a mating contact.

7. The electronic cartridge connector assembly of claim 1, each contact further comprising a stem portion interconnecting said tail end and said connector pad, and a retention beam extending from said connector pad, said retention beam being snapably received into a recess in said housing in order to resist normal forces experienced by said connector pad from a mating contact.

8. The electronic cartridge connector assembly of claim 1, each contact further comprising a stem portion extending from said tail end to said connector pad, said stem portion including an alignment arm extending transverse to a longitudinal axis of said stem portion, said alignment arm being located along said stem portion and relative to said tail ends such that when the alignment arm is received in a transverse slot in said housing, said alignment arm locates said tail end in said first plane.

9. The electronic cartridge connector assembly of claim 1, wherein at least one contact further comprising an alignment member spaced a predefined distance from said tail end, and wherein said housing includes channels receiving said contacts, at least one of said channels having notches therein to receive said alignment member, said notches and alignment member cooperating to locate said tail end in said first plane.

10. The electronic cartridge connector assembly of claim 1, each contact further comprising a stem portion having an enlarged segment configured to be releasably joined to a carrier strip before securing said contacts to said housing, said enlarged segments of said contacts being aligned in a common plane proximate a rear face of said housing, said contact pads being aligned in said second plane proximate a front face of said housing.

11. The electronic cartridge connector assembly of claim 1, wherein said housing further comprising a plurality of channels aligned parallel to one another and opening through a rear face of said housing, each of said plurality of channels having an open bottom end exposing said tail ends of said contacts, each of said plurality of channels communicating with a hole extending through a front face of said housing, said holes exposing said connector pads through said front face.

12. The electronic cartridge connector assembly of claim 11, wherein said channels are alternately a first distance in length and a second distance in length, said channels alternately extend a first distance from said holes to said open bottom ends and a second distance from said holes to said open bottom ends, and said channels alternately separate said holes from said bottom ends by a first distance and said holes from said bottom ends by a second distance.

13. The electronic cartridge connector assembly of claim 12, wherein said channels that extend said first distance from said holes to said open bottom ends further include support members traversing said channel, said support members retaining said contacts within said housing.

14. The electronic cartridge connector assembly of claim 1, wherein said housing further comprises a plurality of channels aligned parallel to a one another and each contact further comprising a stem portion, said channels retaining said stem portions within said housing.

15. The electronic cartridge connector assembly of claim 1, further comprising a printer connector having a plurality of slots retaining an equal plurality of spring contacts therein, said plurality of spring contacts having first ends secured in corresponding first ends of said slots and second ends being biased outward from said second ends of said slots, said second ends of said spring contacts directly electrically engaging said connector pads.

16. The electronic cartridge connector assembly of claim 13, wherein said spring contacts are deflectable inward toward said slots and said first ends of said spring contacts configured to be directly soldered to a printed circuit board.

17. The electronic cartridge connector assembly of claim 1, wherein each contact further comprises a first stem portion and a second stem portion, said first stem portion extending from a side of said connector pad and said second stem portion extending from an opposite side of said connector pad, said first stem and said second stem being extended in a direction perpendicular to said second plane when inserted through a front face of said housing, said first stem and said second stem being bent to extend in a direction parallel to said second plane.

18. The electronic cartridge connector assembly of claim 1, wherein said contacts are loaded through holes in a front face of said housing until rear sides of said connector pads abut against support surfaces of said housing to resist normal forces exerted on said connector pads by mating contacts.

19. The electronic cartridge connector assembly of claim 1, wherein said housing includes channels, said channels extending parallel to a front face of said housing and said channels having at least one open end for receiving said contacts that are slidably located into said open ends of said channels.

20. The electronic cartridge connector assembly of claim 1, wherein said housing includes a plurality of channels separated by contact support walls, said channels having at least one open end to receive said contacts, said support walls having contact receiving edges extending along a side of said housing to support said connector pads against normal forces induced by mating contacts.

* * * * *